US006381774B1

(12) United States Patent
Wales

(10) Patent No.: US 6,381,774 B1
(45) Date of Patent: May 7, 2002

(54) RETRACTABLE HOSE FOR FAUCET

(75) Inventor: Michael Wales, Riverside, CT (US)

(73) Assignee: Resources Conservation, Inc., Stamford, CT (US)

( * ) Notice: Subject to any disclaimer, the term of this patent is extended or adjusted under 35 U.S.C. 154(b) by 0 days.

(21) Appl. No.: 09/709,065

(22) Filed: Nov. 9, 2000

Related U.S. Application Data

(60) Provisional application No. 60/219,223, filed on Jul. 18, 2000.

(51) Int. Cl.[7] ..... E03C 1/04
(52) U.S. Cl. ..... 4/678; 239/195; 137/801
(58) Field of Search ..... 4/678; 239/195; 137/801

(56) References Cited

U.S. PATENT DOCUMENTS

| | | | | |
|---|---|---|---|---|
| 4,662,768 | A | 5/1987 | Gottwald et al. | 239/588 X |
| 4,827,538 | A | 5/1989 | Heimann et al. | 4/677 |
| 5,073,991 | A | 12/1991 | Marty | 4/678 |
| 5,093,942 | A | 3/1992 | Lang | 4/568 X |
| D343,227 | S | 1/1994 | Dannenberg et al. | D23/238 |
| 5,349,987 | A | 9/1994 | Shieh | 137/801 |
| 5,361,431 | A | 11/1994 | Freier et al. | 4/677 |
| 5,546,978 | A | 8/1996 | Parker | 137/801 X |
| 5,758,690 | A | 6/1998 | Humpert et al. | 137/801 |
| 5,822,811 | A | 10/1998 | Ko | 4/678 |
| 5,934,325 | A | 8/1999 | Brattoli et al. | 137/801 |

FOREIGN PATENT DOCUMENTS

DE 0 012 890 A1 5/1979

*Primary Examiner*—Robert M. Fetsuga
(74) *Attorney, Agent, or Firm*—St. Onge Steward Johnston & Reens LLC

(57) ABSTRACT

A retractable sprayer hose installation kit for use with a faucet assembly has a connector attachable to a discharge opening of the faucet assembly and traversed by a flexible hose, a free end of which is inserted into a spout, an a proximal end traverses a bushing which provides connection between the hose and a hand-held spray head. The connector receives a fitting which is recessed to form a seat for a stopper attachable to the proximal end of the flexible hose and engaging the seat in a retracted position of the spray head. The kit further has a bushing releasably engaging the spray head and dimensioned to provide the spray head and the hose with simultaneous displacement between the retracted and extended positions of the spray head.

20 Claims, 3 Drawing Sheets

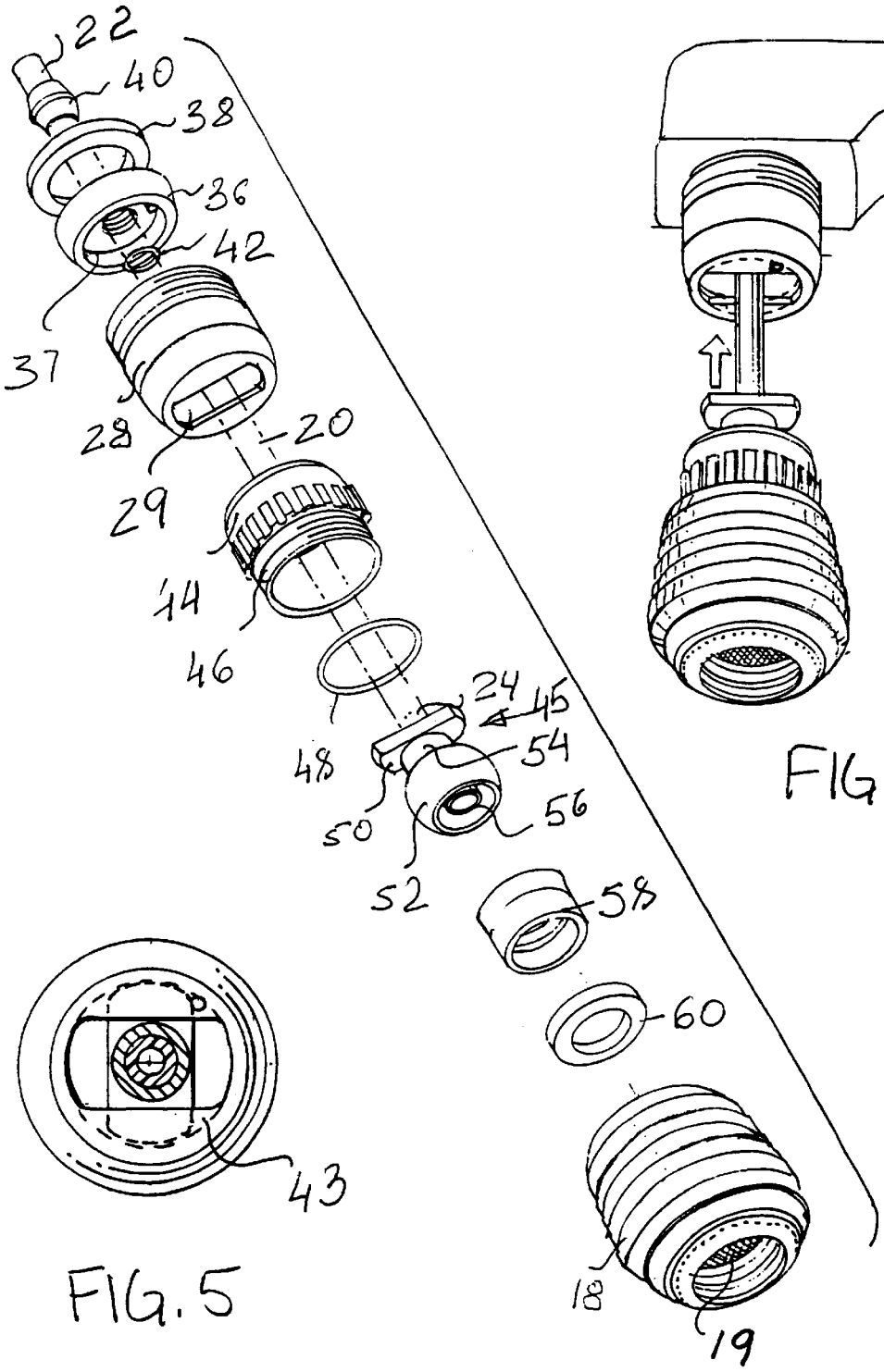
FIG. 3
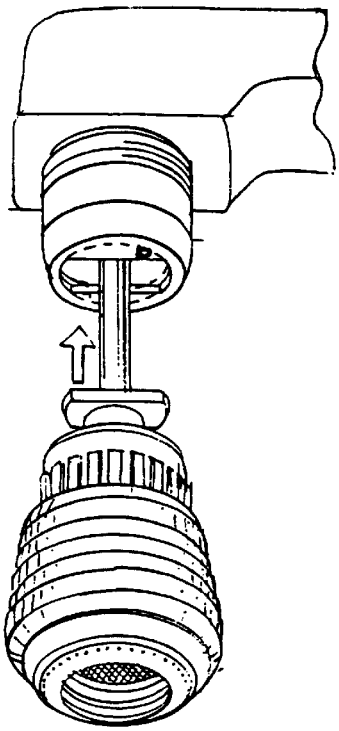
FIG. 4
FIG. 5

RETRACTABLE HOSE FOR FAUCET

This application is based on a provisional U.S. application Ser. No. 60/219/223 filed Jul. 18, 2000

FIELD OF THE INVENTION

This invention relates to faucet sprayer hoses, and more particularly to an aftermarket product for use with kitchen and lavatory faucets.

BACKGROUND OF THE INVENTION

The installation and use of faucets with retractable spray assemblies has become widespread. Old designs of faucets however rarely implement the retractable spray assemblies thus offering the aftermarket suppliers an unlimited field for replacement of stationary assemblies with the retractable assemblies. In addition, even modern retractable assemblies wear out in a relatively short period of time and need to be replaced as well.

The design and use of faucets having retractable spray assemblies is well known. Typically, a hand-held spray head of such assembly is positioned in the outlet of the tap fitting whereby the hand-held spray head when in an inserted position can be used as stationary outlet and by removal from the outlet can be used as a hand-held spray for dish washing. A typical hand-held spray head is connected to a water supply outlet by means of a hose extending between the water supply outlet and a discharge end of a spout.

An access to old plumbing fixtures and particularly to kitchen water supply outlets is not easy and is usually time consuming even for a professional plumber. The following few examples of the known retractable assemblies represent rather a typical replacement hose kit and problems encountered during its installation.

U.S. Pat. No. 5,546,978 to Parker discloses a replacement faucet hose installation kit including a flexible hose segment connected to an outlet port and extending through the entire water-conveying conduit to be attached to a hand-held spray head. Installation of such assembly requires disassembling of a faucet unit in order to provide access to the outlet port hidden under a sink.

U.S. Pat. No. 4,827,538 to Heimann discloses a retractable hose assembly, wherein a flexible hose extends through a spout and has its inlet end biased inwardly by a weight. Installation of this assembly is also difficult primarily because the inlet end of the hose extends through the entire inner conduit leading to a wall water pipe.

U.S. Pat. No. 5,822,811 discloses an extensible faucet assembly having a hose extending through the entire assembly and connected to a mixing valve which is mounted upstream from the assembly. Similarly to the above-discussed structures, replacement and installation of a retractable hose assembly is time consuming.

It is, therefore, desirable to provide a retractable hose assembly kit which can be easily attached to existing faucet assemblies. Also desirable is a retractable hose assembly kit attachable to a discharge opening of a faucet assembly and having a hose which is sized and shaped to convey water toward a hand-held spray head as the hose's inlet end freely travels along an inner conduit. A retractable hose assembly kit having a locking mechanism adapted to lock the hand-held spray head in a retracted position of the hose assembly is also desirable.

SUMMARY OF THE INVENTION

A kit which is comprised of a connector matable with a discharge opening of an existing spout and providing a guide for a flexible hose, a proximal end of which is connected to a hand-held spray head and a distal free end is inserted into an inner conduit meets all of the above requirements.

In accordance with one aspect of the invention, the free end of the hose is freely displaceable inside the conveying conduit upon applying an external force to the spray head in order to displace the latter between extended and retracted positions.

The free end of the hose has a guide assembly which includes a positioning seat having a central channel which is sized to allow the hose to slide through the seat in such a manner that inner and outer surfaces of the channel and hose, respectively, provide a water seal during displacement of the hose. As a consequence, the hose delivers water to a discharging opening of the spray head in the extended position of the latter.

The positioning seat is so shaped that its outer surface is sealingly pressed against an inner peripheral wall of a connector which serves to attach the entire hose assembly to a discharging opening of the spout. This, a size and shape of the connector, positioning seat and the hose are selected to allow water to flow only through the hose, eliminating thereby a need for direct attachment of an inlet end of the hose to a mixing barrel or a wall pipe.

In accordance with another aspect of the invention, the proximal end of the hose can be locked in the connector to position the spray head in its retracted position by means of a locking assembly. The locking assembly prevents displacement of the hose relative to the connector and includes a locking flange which is received in a nest formed between a bottom of the connector and a bottom of the positioning seat. Due to the unattached free end of the hose which is rotatably fixed with locking flange, the latter rotates about an axis between a position wherein axial displacement of the hose is arrested and a position wherein the hose and the flange move axially.

The retractable hose assembly may be just a few inches long because the hose is unattached to a water inlet and easily installed by mating the connector with a discharge opening of the spout as the hose is inserted into the inner conduit of the faucet assembly.

It is therefore an object of the invention to provide a kit including a retractable hose assembly which is easy to install in a faucet assembly.

Sill another object of the invention is to provide a retractable hose assembly that does not need direct attachment of the hose to an water inlet.

Yet another object of the invention is t provide a hose assembly which has a water proof structure allowing water flow only through the hose as a spray head is displaceable between its retracted and extended positions.

It is a further object of the invention provide a locking assembly for arresting further displacement of the spray head in its retracted position.

The above and other objects, features and advantages will become more readily apparent from the detailed description of the preferred embodiment of the invention accompanied by the following drawings, in which:

BRIEF DESCRIPTION OF THE DRAWINGS

FIG. 3 is an elevated exploded view of a retractable hose assembly of FIGS. 1 and 2.

FIG. 4 is an enlarged perspective view of a retractable hose assembly shown as a spray head is displaced between fully extended and retracted positions.

FIG. 5 is a cross-sectional view taken along lines 5—5 seen in FIG. 2.

DETAILED DESCRIPTION OF THE DRAWINGS

Figure 1:
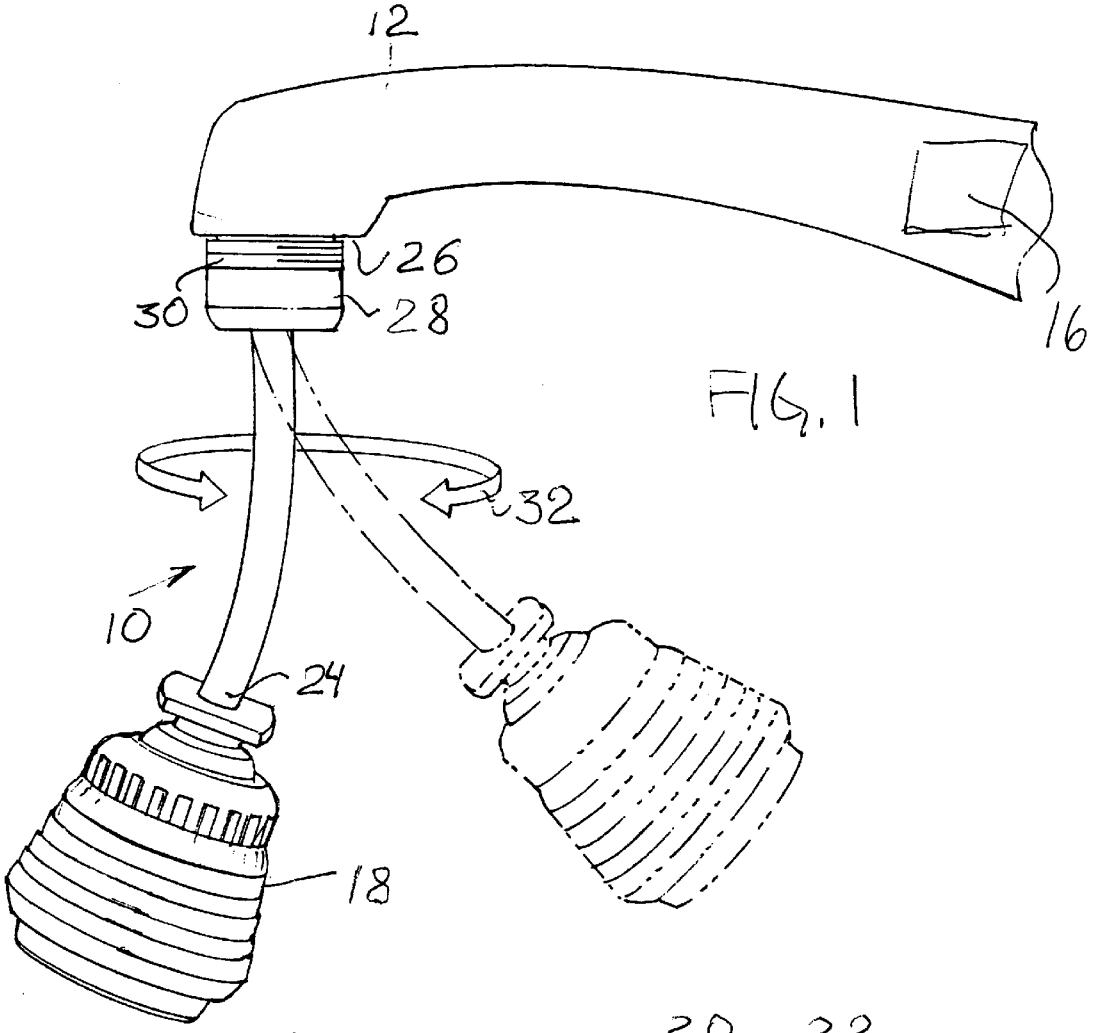
FIG. 1 is an elevated view of a retractable hose assembly shown in its extended position.

Referring to FIGS. 1–6, a retractable hose assembly 10 is removably attached to a spout 12 to serve as a water outlet delivering water from a water inlet assembly, which is typically comprised of hot- and cold-water wall pipes and a mixing valve, shown only diagrammatically at 16 in FIG. 1.

Figure 2:
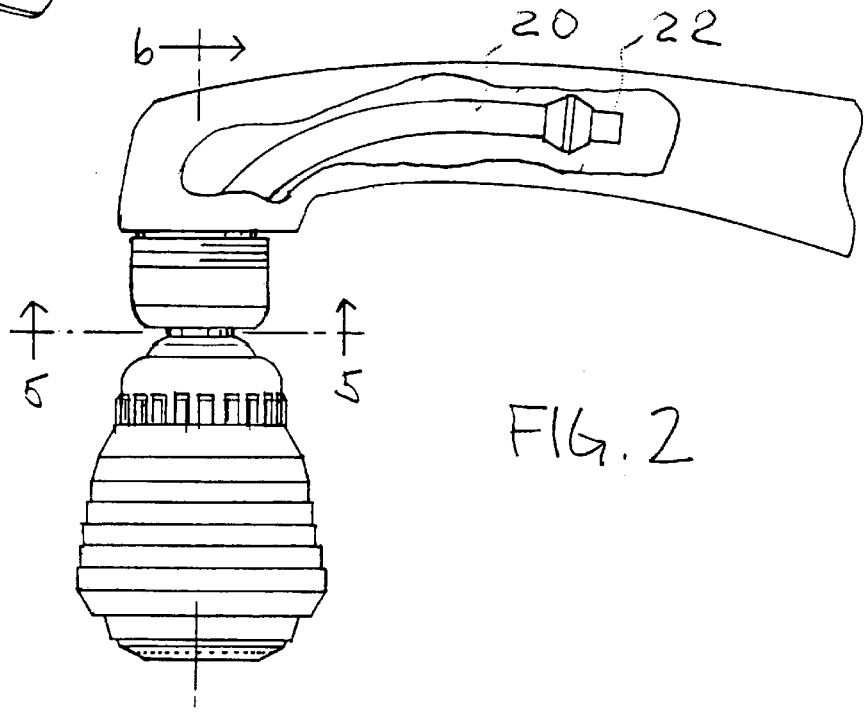
FIG. 2 is an elevated view of a retractable hose assembly shown in a retracted position.

A hand-held spray head 18 having a perforated screen 19 is adjustable to form different patterns of jet streams, as known in the art, and displaceable between extreme extended and retracted positions, as shown in FIGS. 1 and 2, respectively, upon application of an external force. Due to a structure of the retractable hose assembly, as will be explained below, the entire stream of water from the inlet water assembly traverses the flexible hose, which delivers water to the spray head in any of its positions.

In accordance with one aspect of the invention, the hose assembly 10 includes a connector 28 provided with an external thread 30 manufactured to mate with an internal thread which is customarily provided in a discharge opening 26 of the spout. Therefore, replacing an original spray nozzle with the connector 28 constitutes the entire installation which avoids time-consuming procedures usually associated with affixing known retractable assemblies to a faucet assembly.

A length of a flexible hose 20 having a free end 22 and a proximal end 24 is determinative of how far away from the discharge opening 26 the spray head 18 can be extended. As particularly shown in FIG. 2, the free end 22 of the flexible hose is not attached to the water inlet assembly and is movable along the spout's interior as the held-hand spray head 18, which is connected to the proximal end 24 of the hose, is displaced between its positions. The entire retractable hose assembly is dimensioned such that when a user swings the hose 20 in any of the spray head's extended positions, as indicated by a double-head arrow 32 in FIG. 1, the entire water stream entering the proximal end 24 of the hose exits through the spray head.

Turning to FIG. 3, the retractable hose assembly constituting a kit has a number of elements, each provided with a respective central opening or a passage, which passages and openings collectively constitute a channel traversed by the hose. Specifically, an outlet end of the connector 28 has an opening 29 having a width which is substantially equal to a diameter of the hose. Due to the inherent elasticity of the hose's outer sleeve, a frictional force generated between the hose and the opening's edges is insignificant and thus an insubstantial force applied too the spray head would be sufficient to displace it.

An interior of the connector 28 receives a first fitting 36 having an outer dimension substantially the same as an inner diameter of the connector to provide reliable circumferential engagement between these elements. An inner edge 37 can be dimensioned substantially equal to the diameter of the hose thus practically eliminating a water leakage through the opening 29. Alternatively, a washer can be provided to compensate a radial gap between the hose and the inner edge 37 of the first fitting. An O-ring 38 completes filling of the interior of the connect 28 and, analogously to the outer dimension of the fitting 36, has its outer peripheral surface circumferentially pressing against the inner wall of the connector 28 to provide a water-proof seal.

Figure 6:
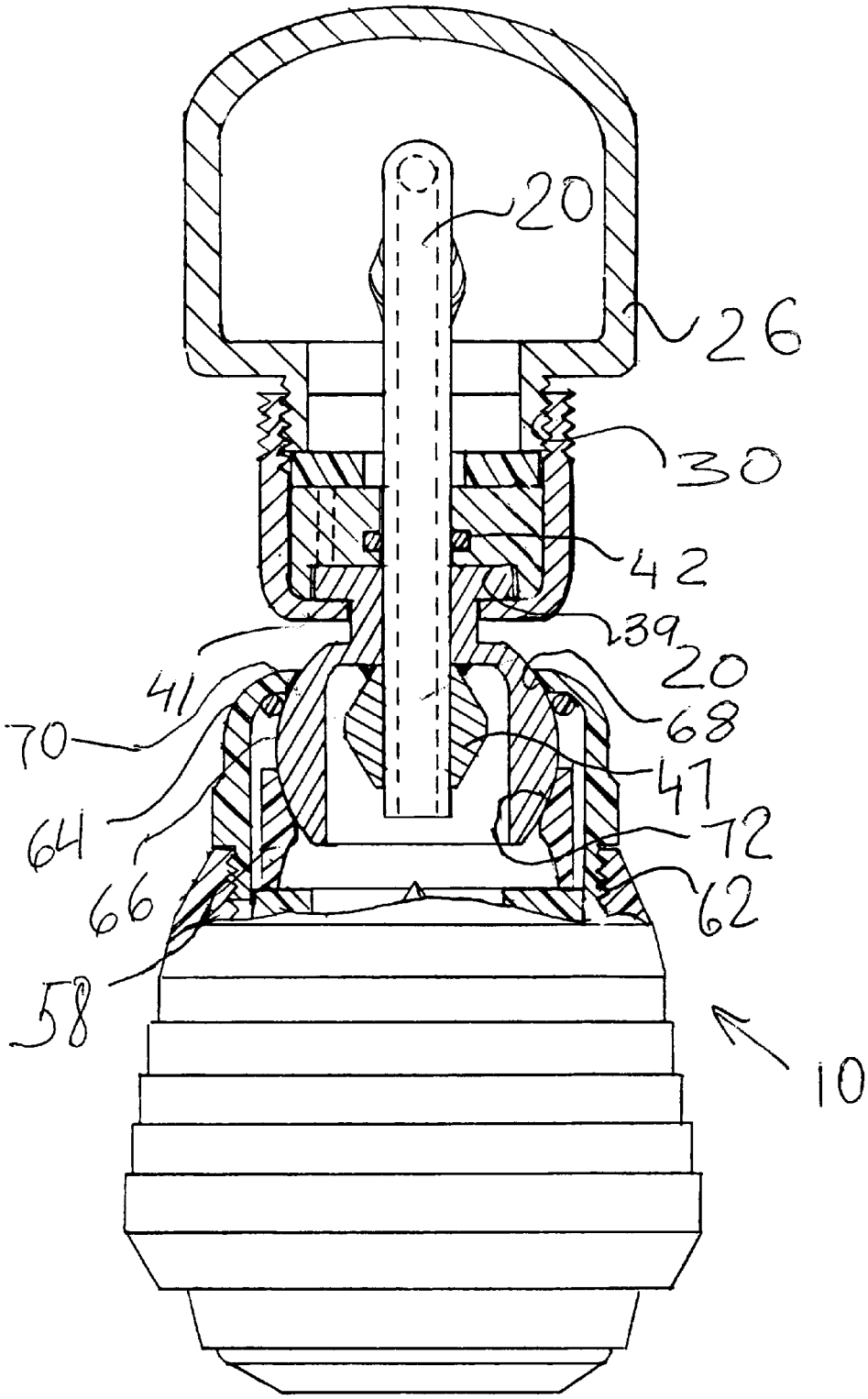
FIG. 6 is an axial view of a retractable hose assembly taken along lines 6—6 as shown in FIG. 2.

Turning to FIGS. 5 and 6 illustrating the retractable hose assembly 10 in the retracted position, the inner edge of the fitting 36 is recessed at 43 (FIG. 5) to have its bottom 39 spaced from a bottom 41 of the connector 28. As is shown, the recess 43 has a U-shaped cross-section and terminates at a distance from the inner wall of the connector. As a consequence, a space between the bottom 41 of the connector and the bottom of the fitting 36 is dimensioned to receive a flange 50 of a front stopper 45, which is attached to the proximal end 24 of the hose 20, to prevent further displacement of the spray head after it has reached the retracted position.

Particularly, the flange 50 is a plate having an outer peripheral surface shaped complementary to a contour of the opening 29 in order to enter and substantially fill the recess 43 in the retracted position. However, the plate is so shaped that it is able to rotate from a release position shown in phantom lines in FIG. 5 to a locking position shown in solid lines, wherein the plate bridges edges of the opening 29 defining its width. Thus, the retractable assembly is locked in the retracted position, wherein any further displacement is arrested, unless the spray head is rotatable to bring the plate in its release position. In order to ensure than no leakage occurs through the opening 29 the fitting 36 has an annular groove receiving an O-ring 42 sealing a radial gap between the hose 20 and the fitting.

The front stopper 45 has a cylindrical intermediary sleeve 54 connecting the pate 50 with a skirt 52 which is provided with an inner diameter larger than a diameter of the cylindrical sleeve and has a U-shaped inner cross-section. The proximal end 24 of the hose 20 extends through an inner passage of the sleeve 54, which has an inner diameter substantially equal to the diameter of the hose. In order to ensure simultaneous displacement of the front stopper with the hose, the proximal end 24 of the hose has a polygonal element 47 fixed to an outlet end of the sleeve 54 and having an inner passage which is aligned with the passage of the sleeve and has the same inner diameter.

Attachment between the spray head 18 and the proximal end of the hose 20 is provided by means of a bushing 44 which has an outer thread 46 mating with an inner thread 62 of the spray head 18, as better seen in FIG. 6. Particularly, the bushing 44 has a bell shape with an inlet end 64 which is somewhat narrower than its outlet threaded end 5 and dimensioned to circumferentially engage an outer surface 66 of the skirt 52 of the front stopper 45. The outer surface 66 of the skirt is outwardly concave and has a portion 68 extending complementary to an edge 70 of the inlet end 64 of the bushing to provide engagement between these elements as the spray head is displaceable towards its retracted position. A fitting 58 (FIG. 3) engages a portion of the outer surface 66 of the skirt in such a manner that a portion of the skirt presses against an inwardly convex portion 72 of the fitting. A longitudinal dimension of the bushing 44 is so selected that the skirt 52 of the front stop is fixedly engaged between the inlet end of the bushing and the fitting 58 when the bushing is fully screwed into the spray head. Attachment between the hose and the spray head is completed by inserting an O ring 60 between an outlet end of the fitting 58 and the spray head.

Note that shapes, cross-sections and dimensions of the above-disclosed elements can vary provided that their inner passages and openings are aligned in the retracted positions and dimensioned to receive the flexible hose. Further, engagement between the front stop 45 and the connector can differ from the disclosed one by having differently shaped engaging elements as long as relative displacement between these elements would allow the front stopper to have the locking and release positions.

Although the invention has been described with reference to a particular arrangements of parts, features and the like, these are not intended to exhaust all possible arrangements or features, and indeed many other modifications and variations will be ascertainable to those of skill in the art.

What is claimed is:

1. A retractable sprayer hose installation kit for use with a faucet assembly having a spout with a discharge opening and a water inlet port, the kit comprising:

a flexible hose insertable into the spout and having proximal and free opposite ends, the flexible hose being dimensioned and shaped to provide flow communication between the inlet port and the discharge opening; and a spray assembly including a hand-held spray head, which is in flow communication with and attached to the proximal end of the flexible hose, displaceable between an extended position, wherein the spray head is spaced from the discharge opening, and a retracted position, wherein the spray head is displaced next to the discharge opening as the free end of the flexible hose occupies a position between the inlet port and the discharge opening.

2. The kit defined in claim 1 wherein the spray head assembly includes a connector having an external thread mating with an internal thread provided on the discharge opening of the spout.

3. The kit defined in claim 2 wherein the connector has an internal passage and an outlet end provided with an opening traversed by the flexible hose, the opening having a width which is substantially equal an outer diameter of the flexible hose.

4. The kit defined in claim 1 wherein the proximal end of the flexible hose is fixedly received in a proximal stopper having a skirt which faces the spray head and a plate which is shaped and dimensioned to fit the opening of the outlet end of the connector as the spray head is displaced towards the retracted position.

5. The kit defined in claim 4 wherein the plate is fully retracted into an interior of the connector in the retracted position of the spray head, the retractable hose assembly further comprising an inlet fitting having an outer periphery pressed against an inner periphery of the connector.

6. The kit defined in claim 5, wherein the inlet fitting has a recessed bottom spaced from the outlet end of the connector at a distance to form a compartment receiving the plate in the retracted position of the spray head and dimensioned to allow the plate to rotate in a locking position, wherein the plate extends across opposite edges of the opening defining the width thereof to register the retracted position of the spray head.

7. The kit defined in claim 4 wherein the skirt has a passage receiving the proximal end of the flexible hose.

8. The kit defined in claim 4 wherein the inlet fitting has an inner annular recess receiving an O-ring to seal a radial gap between an inner passage of the inlet fitting and the flexible hose which slides along the inner passage as it travels along with the spray head between the extended and retracted positions.

9. The kit defined in claim 8 wherein the connector further receives a sealing ring atop the seat, said sealing ring, seat, and the fitting having coaxial channels which form an inner conduit traversed by the flexible hose.

10. The kit defined in claim 2 wherein the free end of the hose has a distal stopper shaped and sized to be larger than the width of the opening of the connector to prevent further displacement of the hose after the spray head has reached the extended position.

11. The kit defined in claim 1 wherein the spray head has an internal passage in flow communication with the flexible hose and extending between inlet and outlet ends of the spray head, the inlet end having an internal thread, the kit further comprising a bushing providing a detachable connection between the spray head and the flexible hose.

12. The kit defied in claim 11 wherein the bushing has an outer thread mating with the inner thread of the shower head and provided with an inner passage surrounding the skirt of the proximal stopper, the bushing being dimensioned to prevent relative axial displacement between the flexible hose and the spray head in a fully engaged position between the spray head and the bushing when their threads are engaged along the entire thread length.

13. The kit defined in claim 12 further comprising an outlet fitting received in the bushing and pressing against a seat of the spray head, the outlet fitting having an annular inlet end sealingly engaging an inlet end of the skirt in a fully engaged position of the bushing and the spray head.

14. The kit defined in claim 4 wherein the proximal stopper has an intermediate cylindrical sleeve between the plate and te skirt which has a central passage having an inner diameter substantially equal to the outer diameter of the flexible hose.

15. A retractable sprayer hose installation kit for use with a faucet assembly having a spout with a threaded discharge opening and a water inlet port, the kit comprising:

a flexible hose insertable into the spout and having proximal and free opposite ends, the flexible hose being dimensioned and shaped to provide flow communication between the inlet port and the discharge opening;

an outlet stopper attached to the proximal end of the flexible hose to move therewith;

a hand-held spray head engaging the proximal end of the flexible hose to be in flow communication with the hose and to travel therewith between extended and retracted positions of the spray head; and a connector traversed by the hose and detachably engaging the discharge opening of the faucet assembly, the connector selectively engaging the outlet stopper when the spray head is displaced in its retracted position, wherein the spray head is adjacent to the discharge opening, and disengaging the outlet stopper to enable the spray head to travel to its extended position, wherein the spray head is spaced from the discharging opening.

16. The kit defined in claim 15 wherein the connector has an interior receiving a first fitting which has an outer peripheral surface urging against an inner peripheral surface of the interior and an internal passage traversed by the flexible hose, the first fitting having a recessed outlet end spaced from an opening, which is provided in an outlet end of the connector for receiving the outlet stopper in the retracted position o the spray head, and forming a compartment with the bottom of the connector which is dimensioned to enable the outlet stopper to rotate in a locking position, wherein displacement of the spray head is arrested.

17. The kit defined in claim 16 wherein the outlet stopper has a plate dimensioned to penetrate the opening in the bottom of the connector and filing the compartment, but able to be angularly displaced therein to and out of the locking position of the outlet stopper, the outer stopper having a outlet skirt, which is dimensioned to be larger than the opening of the connector, and an internal passage aligned with the internal passage of the first fitting in the retracted position of the spray head and traversed by the flexible hose, the internal passages of the first fitting and the outlet stopper being dimensioned to be substantially the same as an outer diameter of the flexible hose.

18. The kit defined in claim 15 further comprising a bushing provided with a outlet end threadedly engaging an inlet end of the spray head and having an inlet end circumferentially abutting the outlet skirt of the outlet stopper.

19. The kit defined in claim 18 further comprising a second fitting engaging the outlet skirt, the bushing being so dimensioned that when it is fully mated with the spray head, the outer fitting is displaceably fixed with the spray head by being engaged between the outlet end of the bushing and he second fitting.

20. A method for installing a retractable hose assembly in a faucet assembly, which is provided with a spout having a discharge opening, the method comprising the steps of:

inserting a flexible hose into the interior of the spout;

attaching a connector having an inner passage traversed by the flexible hose to the discharge opening, the connector having an interior filled with a fist fitting recessed at its outlet end to form a compartment in the connector;

providing a stopper on a proximal end of the flexible hose, the stopper having an inner passage traversed by the flexible hose and including a plate, which faces an opening provided on an outlet end of the connector and opening into the compartment, and a skirt with an outer diameter substantially greater than an outer diameter of the flexible hose;

providing a bushing having an inlet end circumferentially pressing against the skirt and attachable to a hand-held spray head;

providing a second fitting received in the spray head and having an inlet end which engages the skirt of the stopper upon attachment of the connector to the spray head to enable the spray head to be displaceably fixed with the flexible hose for traveling between a retracted position, wherein the plate is received in the compartment to arrest displacement of the spray head in the vicinity of the discharge opening, and an extended position, wherein the spray head is distanced from the discharge opening.

* * * * *